US010724220B2

(12) United States Patent
Liu

(10) Patent No.: US 10,724,220 B2
(45) Date of Patent: Jul. 28, 2020

(54) WATER SEAL DEVICE FOR REMOVING ODOUR OF TOILET

(71) Applicant: XIAMEN JIJIE SANITARY WARE CO., LTD., Xiamen, Fujian (CN)

(72) Inventor: Jianping Liu, Xiamen (CN)

(73) Assignee: XIAMEN JIJIE SANITARY WARE CO., LTD., Xiamen, Fujian (CN)

( * ) Notice: Subject to any disclaimer, the term of this patent is extended or adjusted under 35 U.S.C. 154(b) by 34 days.

(21) Appl. No.: 16/313,133

(22) PCT Filed: Nov. 8, 2017

(86) PCT No.: PCT/CN2017/109820
§ 371 (c)(1),
(2) Date: Dec. 25, 2018

(87) PCT Pub. No.: WO2018/103489
PCT Pub. Date: Jun. 14, 2018

(65) Prior Publication Data

US 2019/0194926 A1 Jun. 27, 2019

(30) Foreign Application Priority Data

Dec. 10, 2016 (CN) ..... 2016 2 1495170 U

(51) Int. Cl.
*E03D 9/05* (2006.01)
*E03D 11/06* (2006.01)

(52) U.S. Cl.
CPC ..... *E03D 9/05* (2013.01); *E03D 11/06* (2013.01)

(58) Field of Classification Search
CPC ..... E03D 9/05; E03D 11/06
USPC ..... 4/213, 216, 219, 349, 351
See application file for complete search history.

(56) References Cited

U.S. PATENT DOCUMENTS 5,325,544 A * 7/1994 Busch ..... E03D 9/052 4/213
5,394,569 A * 3/1995 Poirier ..... E03D 9/04 4/213
2003/0229937 A1* 12/2003 Curtis ..... E03D 9/052 4/216
2006/0085897 A1* 4/2006 Birdsong ..... E03D 9/05 4/213
2009/0235441 A1* 9/2009 Spadola ..... E03D 9/052 4/213
2010/0242161 A1* 9/2010 Yoo ..... E03D 9/05 4/321

* cited by examiner

*Primary Examiner* — Tuan N Nguyen
(74) *Attorney, Agent, or Firm* — Leong C. Lei

(57) ABSTRACT

Disclosed is a water seal device for removing odour of a toilet. The water seal device is mounted in a toilet tank, and consists of an exhaust assembly, a water seal backflow assembly and an electronic control assembly. The device is provided with a powerful exhaust electric motor. After starting, the electronic control assembly supplies power to the exhaust electric motor, and the exhaust electric motor can inhale a gas in a bowl into the tank. Water in a U-shaped trap water seal is pushed and pressed out by means of the gas pressure. When the toilet discharges sewage, the electronic control assembly automatically cuts a power supply, and the exhaust electric motor stops working, and the U-shaped trap water loses the pressure to block gas return.

4 Claims, 6 Drawing Sheets

WATER SEAL DEVICE FOR REMOVING ODOUR OF TOILET

BACKGROUND OF THE INVENTION

1. Field of the Invention

The present invention relates to a sanitary ware product, and more particularly to a water seal device for removing odour of a toilet, which can ensure that the odour won't discharge back in any case.

2. Description of the Prior Art

In recent years, there is an increasing concern for living hygiene. Various smart toilets have been favored by consumers, and the market is prosperous. Therefore, the function of removing the odor of the toilet is becoming more and more important. Various techniques for removing odors have been introduced, including the related patents owned by the applicant. In the recent research and development process, a device not only has the function of discharging odor into the sewer, but also has the function of a reliable backflow water seal. Its structure is simpler, the cost is lower, and the quality is more reliable.

SUMMARY OF THE INVENTION

The present invention provides a water seal device for removing odour of a toilet. The water seal device is simpler and more reliable in structure and has various functions to satisfy the flushing function of the toilet. Not only can the odour of the toilet be discharged into the sewer of the toilet, it can be also ensured that a methane gas in the sewer can be prevented from flowing back to a bathroom in any case.

A water seal device for removing odour of a toilet provided by the present invention is mounted in a toilet tank, and consists of an exhaust assembly, a water seal backflow assembly and an electronic control assembly. The device is provided with a powerful exhaust electric motor. After starting, the electronic control assembly supplies power to the exhaust electric motor, and the exhaust electric motor can inhale the gas in a bowl into the toilet tank. The exhaust pressure is increased by means of the exhaust electric motor. The water in a U-shaped trap water seal is pushed and pressed out by means of the gas pressure and flows into an exhaust tube. The water and the gas are discharged into a sewer from an S bend sewage discharge tube of the toilet. When the toilet discharges sewage, the electronic control assembly automatically cuts a power supply, and the exhaust electric motor stops working, and the U-shaped trap water seal loses the pressure, and the water stored in the toilet tank rapidly flows into the U-shaped trap water seal by means of a water inlet chamber to generate a water seal, thus immediately blocking gas return, and at the same time, it is also ensured that the toilet generates a syphoning function during sewage discharge.

The present invention is achieved by the following technical solutions:

A water seal device for removing odour of a toilet of the present invention consists of an exhaust assembly, a water seal backflow assembly and an electronic control assembly. The water seal device is mounted in a toilet tank. A telescopic tube is inserted through the bottom of the toilet tank. A connecting tube communicates with the S bend sewage discharge tube of the toilet. A water level line on the adjustment device has the same height as the water level of the toilet tank. The device is connected with a power supply.

When the user goes to the toilet, the power switch is activated, and the exhaust electric motor is activated by the electronic control assembly. At a high rotational speed, the exhaust electric motor inhales the air in the toilet tank to generate a negative pressure in the toilet tank. Therefore, the gas in the toilet bowl flows into the toilet tank through the overflow tube on the water discharge valve through the water discharge annular trough, and the odor in the toilet is also discharged into the toilet tank along with the gas flow. Since the gas pressure generated by the exhaust electric motor is greater than the water pressure of the water seal height of the S bend of the toilet, the water surface of the first water seal chamber of the water seal assembly is pressed downward until the water in the first water seal chamber is pressed into the second water seal chamber from the bottom of the water seal chamber, and overflows the exhaust tube mouth, and flows into the S bend sewage discharge tube of the toilet. At this time, the gas affected by the gas pressure also presses the water in the water inlet chamber downward to the bottom of the U-shaped water storage cup. Due to the balance of the gas pressure, the gas in the first water seal chamber flows into the second water seal chamber through the passage at the bottom of the water seal chamber, and the gas flows along the second water seal chamber upwardly into the exhaust tube. The water surface in the water inlet chamber is flush with the water surface of the bottom of the water seal chamber. Because the mouth of the n-shaped exhaust hood is lower than the bottom of the U-shaped water storage cup, the gas is not discharged from the bottom of the n-shaped exhaust hood and can only be discharged into the exhaust tube through the first water seal chamber and the second water sealing chamber.

After using the toilet, when the toilet is flushed, the water discharge valve is opened, and the water level of the toilet tank drops rapidly. At this time, the water level switch on the water surface turns off the power supply of the exhaust electric motor, and the exhaust electric motor stops working, and the gas pressure in the first water seal chamber and the water inlet chamber disappears immediately. Because the water level in the toilet tank is still at a high level, under the action of the water pressure, the water flows into the first water seal chamber and the second water seal chamber from the water inlet chamber to form the U-shaped trap water seal until the water seal water surface in the water seal chamber is flush with the toilet tank water surface. When the water is continuously discharged and the water level of the toilet tank is lower than the mouth of the U-shaped water storage cup, the water in the U-shaped water storage cup no longer flows out. The water seal is maintained at the set height to ensure that the S bend sewage discharge tube has sufficient siphon force to suck the dirt when the toilet is flushed.

DETAILED DESCRIPTION OF THE PREFERRED EMBODIMENTS

Embodiments of the present invention will now be described, by way of example only, with reference to the accompanying drawings.

Figure 1:
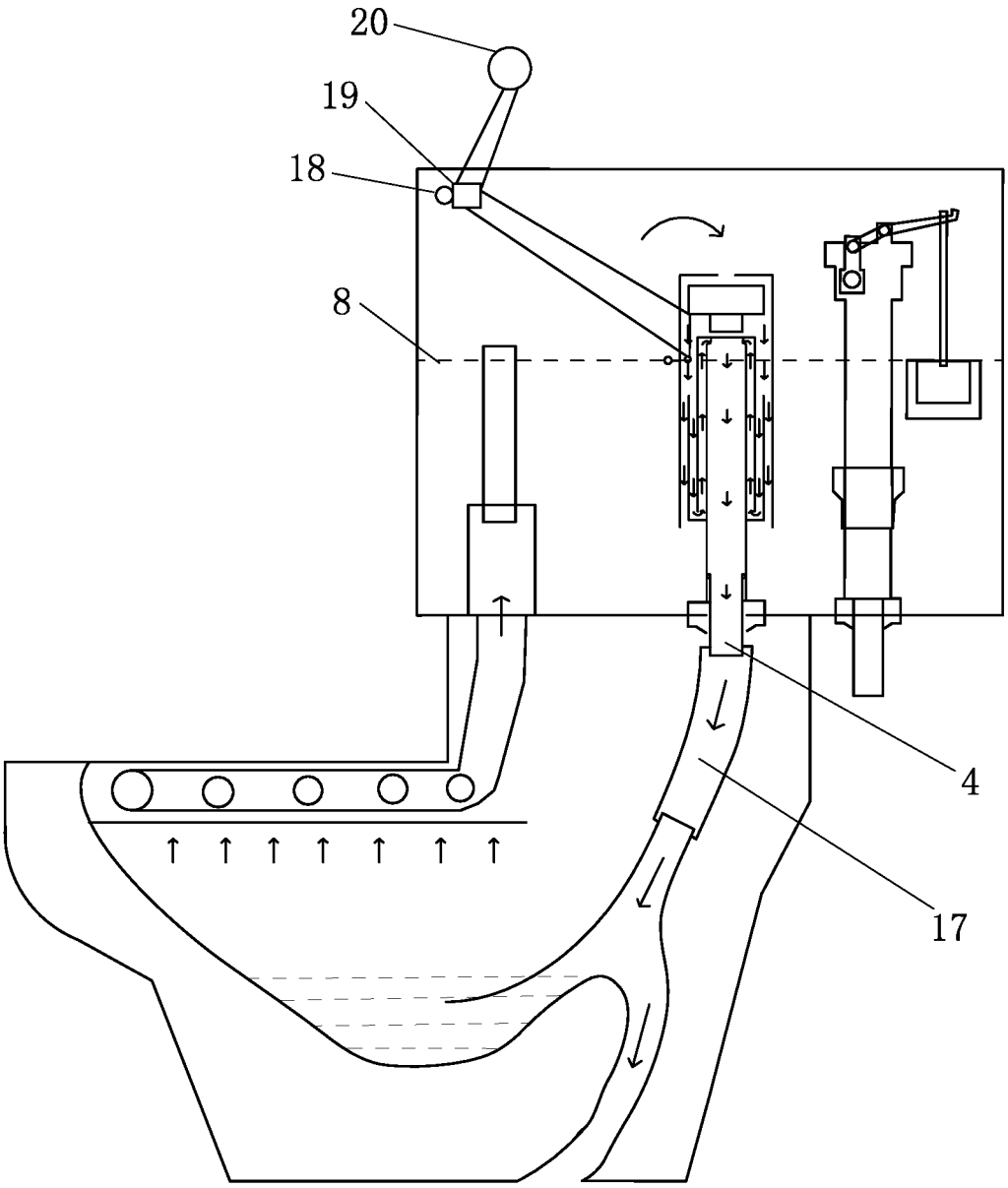
FIG. 1 is a schematic view of the product of the present invention in the toilet.

The present invention will be further described in conjunction with FIG. 1. The present invention discloses a water seal device for removing odour of a toilet. The water seal device is mounted in a toilet tank, and consists of an exhaust assembly, a water seal backflow assembly and an electronic control assembly. A telescopic tube 4 is inserted through the bottom of the toilet tank. A connecting tube 17 communicates with the S bend sewage discharge tube of the toilet. A water level line 8 on the adjustment device has the same height as the water level of the toilet tank. A power switch 18 and an electronic program controller 19 are installed on the toilet tank and connected with a power supply 20.

Figure 2:
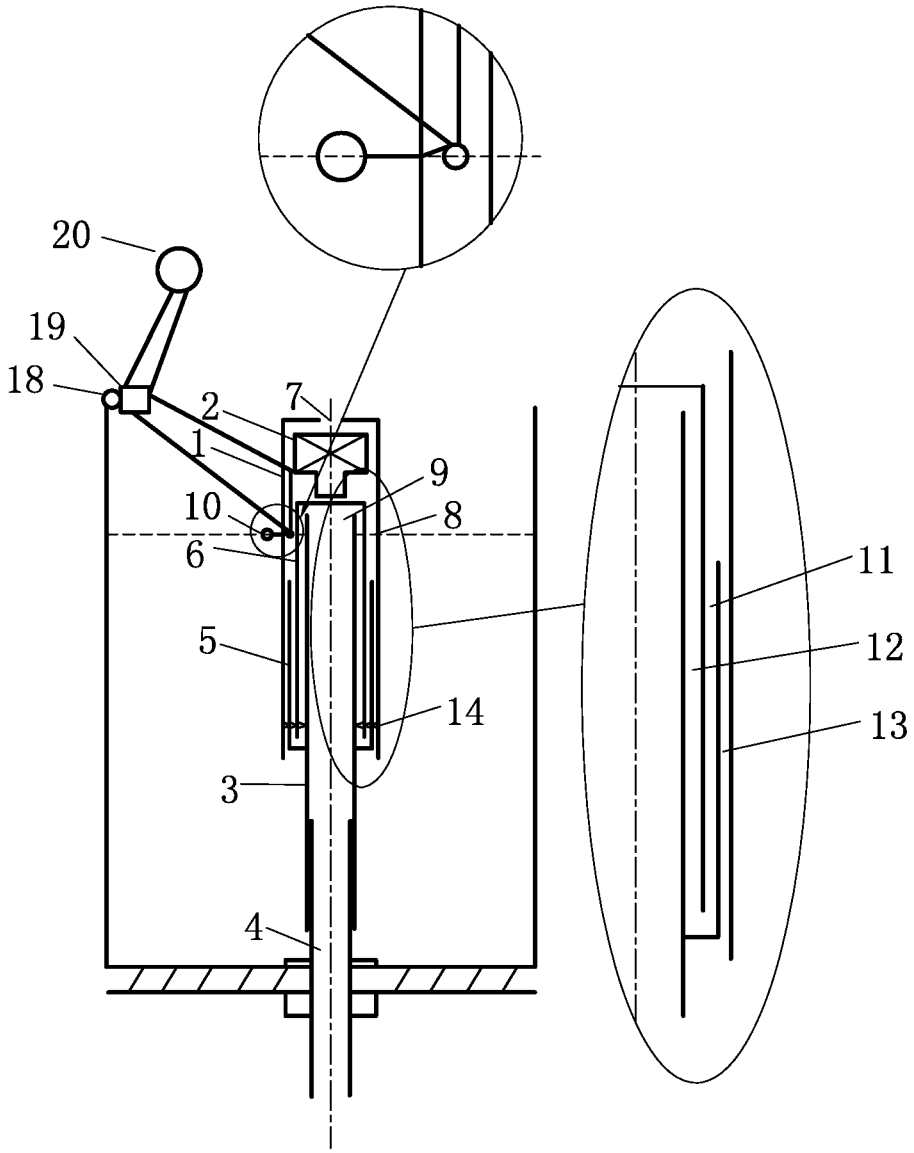
FIG. 2 is a structural view of the product of the present invention.
Figure 3:
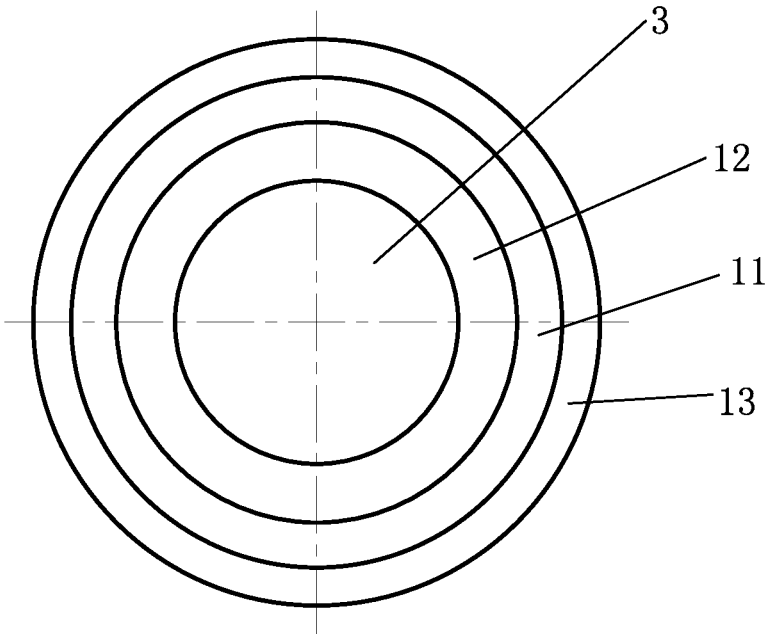
FIG. 3 is a top view of the water seal chamber of the present invention.

The structure of the product of the present invention will now be further described in conjunction with FIG. 2 and FIG. 3. The present invention discloses a water seal device for removing odour of a toilet. The water seal device is mounted in a toilet tank, and consists of an exhaust assembly, a water seal backflow assembly and an electronic control assembly. The exhaust assembly consists of an n-shaped exhaust hood 1, an exhaust electric motor 2, an exhaust tube 3, and a telescopic tube 4. The water seal backflow assembly consists of a U-shaped water storage cup 5, an n-shaped water seal hood 6, and the exhaust tube 3. The electronic control assembly consists of a power source 20, a power switch 18, an electronic program controller 19, and a water level switch 10.

The exhaust assembly is fastened on the exhaust electric motor 2 and the water seal backflow assembly through the n-shaped exhaust hood 1. The exhaust electric motor 2 is located inside the top portion of the n-shaped exhaust hood 1 above the water seal backflow assembly. A chamfer formed between the exhaust electric motor 2 and the n-shaped exhaust hood 1 is defined as a gas guide chamfer. The top portion of the n-shaped exhaust hood 1 is formed with an air inlet 7. The n-shaped exhaust hood 1 covers the entire water seal backflow assembly and extends downwardly beyond the bottom of the U-shaped water storage cup 5 of the water seal backflow assembly. The upper part of the n-shaped exhaust hood 1 is marked with a water level line 8. The water level line 8 is disposed at a position higher than the mouth of the U-shaped water storage cup 5 and lower than an exhaust tube mouth 9. The water level switch 10 is disposed at the water level line 8. When the water surface reaches the water level line 8, the water level switch 10 will turn on the exhaust electric motor 2. When the water surface is lower than the water level line 8, the water level switch 10 will turn off the power supply 20 of the exhaust electric motor 2.

The water seal backflow assembly has the exhaust tube 3 as a main body. The exhaust tube 3 is inserted through the U-shaped water storage cup 5 to become an integrated one. The exhaust tube mouth 9 is higher than the water level line 8. The n-shaped water seal hood 6 is fastened in a chamber defined between the exhaust tube 3 and the U-shaped water storage cup 5 to form a first water seal chamber 11 and a second water seal chamber 12. The bottom of the first water seal chamber 11 communicates with the bottom of the second water seal chamber 12 to form a U-shaped water storage water seal. A water inlet chamber 13 is formed between the n-shaped exhaust hood 1 and the U-shaped water storage cup 5. The cross-sectional areas of the first water seal chamber 11, the second water seal chamber 12, the water inlet chamber 13 and the exhaust tube 3 are substantially equal. The first water seal chamber 11, the second water seal chamber 12 and the water inlet chamber 13 communicate with each other to form a ∩-shaped chamber. The n-shaped exhaust hood 1, the exhaust tube 3, the U-shaped water storage cup 5, and the n-shaped water seal hood 6 are supported by a support 14 that does not affect the flow of gas and water.

The electronic control assembly uses a wire to connect the power supply 20, the power switch 18, the electronic program controller 19 and the water level switch 10 in series in an electronic circuit.

Figure 4:
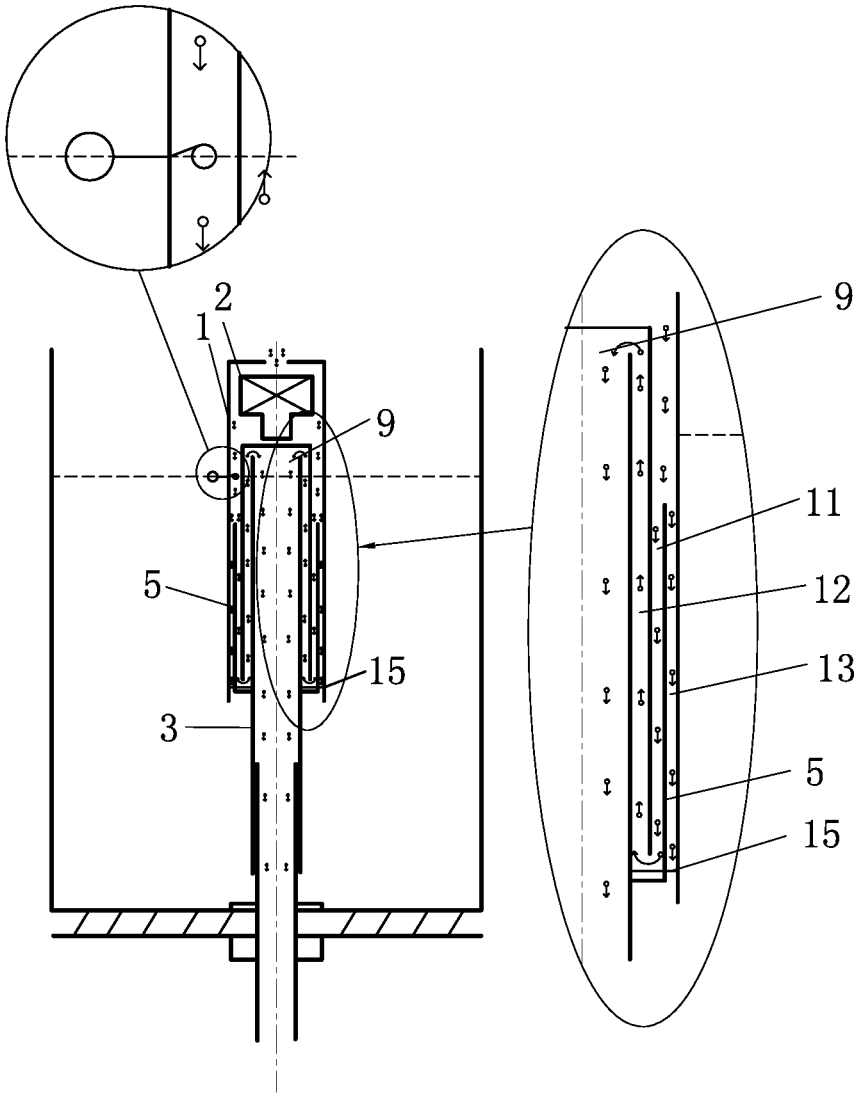
FIG. 4 is a schematic view showing the operation state of discharging odor of the present invention.

The present invention will now be further described in conjunction with FIG. 1 and FIG. 4. When the user goes to the toilet, the power switch 18 is activated, and the exhaust electric motor 2 is activated by the electronic control assembly. At a high rotational speed, the exhaust electric motor 2 inhales the air in the toilet tank to generate a negative pressure in the toilet tank. Therefore, the gas in the toilet bowl flows into the toilet tank through the overflow tube on the water discharge valve through the water discharge annular trough, and the odor in the toilet is also discharged into the toilet tank along with the gas flow. Since the gas pressure generated by the exhaust electric motor 2 is greater than the water pressure of the water seal height of the S bend of the toilet, the water surfaces of the first water seal chamber 11 of the water seal assembly and the water inlet chamber 13 are pressed downward until the water in the first water seal chamber 11 is pressed into the second water seal chamber 12 from the bottom of the water seal chamber, and overflows the exhaust tube mouth 9, and flows into the S bend sewage discharge tube of the toilet. At this time, the gas affected by the gas pressure also presses the water in the water inlet chamber 13 downward to the bottom of the U-shaped water storage cup 5. Due to the balance of the gas pressure, the gas in the first water seal chamber 11 flows into the second water seal chamber 12 through the passage at the bottom of the water seal chamber, and the gas flows along the second water seal chamber 12 upwardly into the exhaust tube 3. The water seal water surface 15 in the water inlet chamber 13 is flush with the water surface at the bottom of the water seal chamber. Because the mouth of the n-shaped exhaust hood 1 is lower than the bottom of the U-shaped water storage cup 5, the gas will not be discharged from the bottom of the n-shaped exhaust hood 1.

Figure 5:
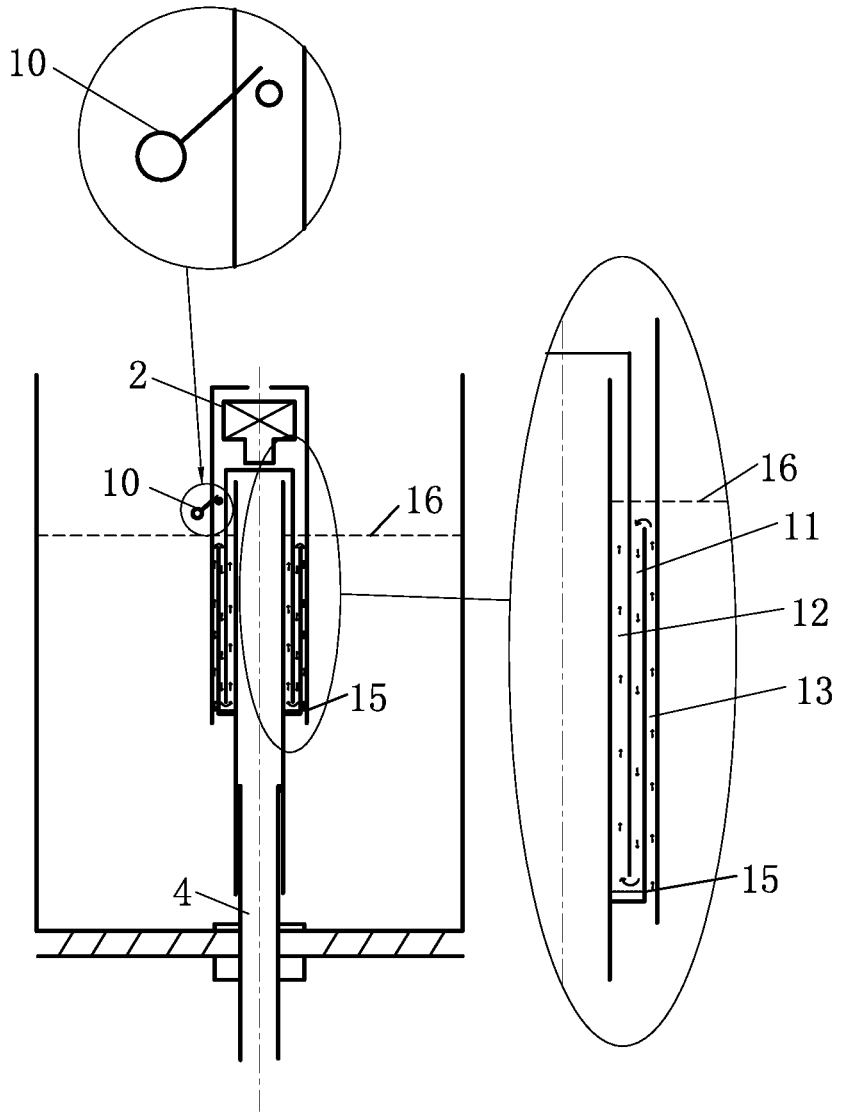
FIG. 5 is a schematic view showing the restoring state of the water seal of the present invention.

The present invention will now be further described in conjunction with FIG. 5. After using the toilet, when the toilet is flushed, the water discharge valve is opened, and the water level of the toilet tank drops rapidly. At this time, the water level switch 10 on the water surface turns off the power supply 20 of the exhaust electric motor 2, and the exhaust electric motor 2 stops working, and the gas pressure in the first water seal chamber 11 and the water inlet chamber 13 disappears immediately. Because the water level in the toilet tank is still at a high level, under the action of the water pressure, the water flows into the first water seal chamber 11 and the second water seal chamber 12 from the water inlet chamber 13 to form the U-shaped trap water seal until the water seal water surface 15 in the water seal chamber is flush with the toilet tank water surface 16.

Figure 6:
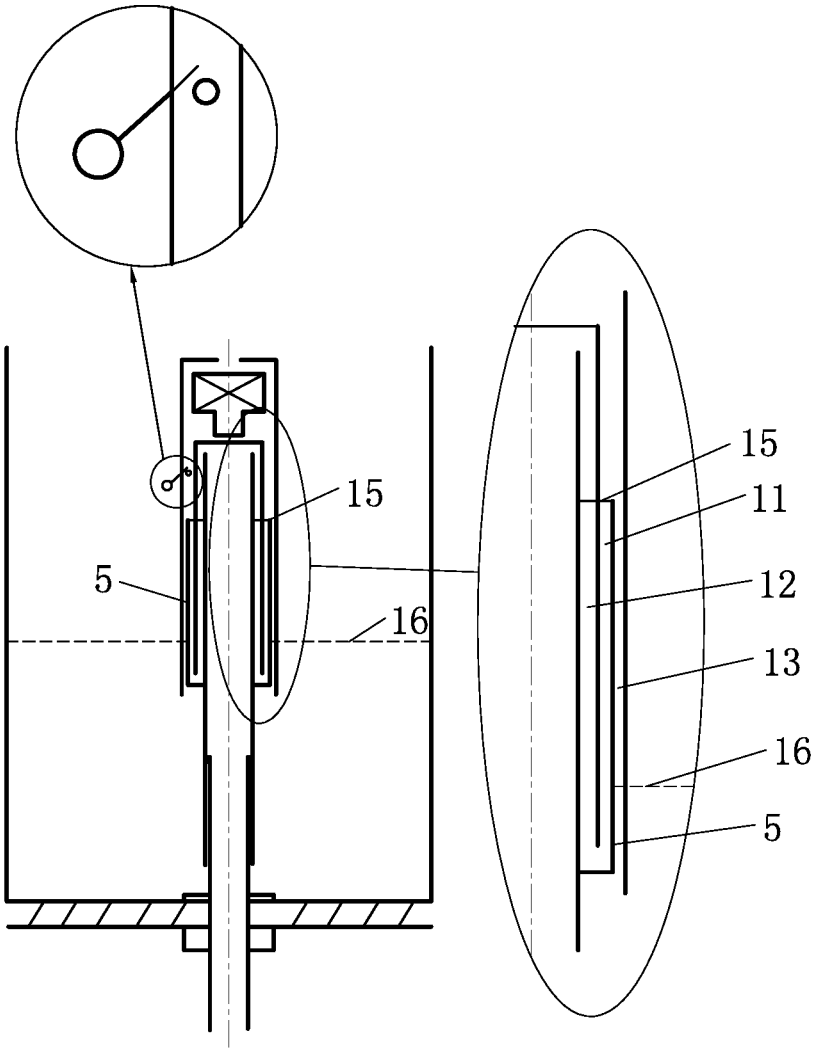
FIG. 6 is a schematic view showing the water seal of the present invention.

The present invention will now be further described in conjunction with FIG. 6. The water is continuously discharged, and the water level of the toilet tank drops. After the water in the water inlet chamber 13 falls to the mouth of the U-shaped water storage cup 5 along with the toilet tank water surface 16, the water in the U-shaped water storage cup 5 no longer flows out. The water surface in the U-shaped water storage cup 5 is maintained beyond the set water seal water surface 15 to ensure that the S bend sewage discharge tube has sufficient siphon force to suck the dirt when the toilet is flushed.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A water seal device for removing odour of a toilet, the water seal device being mounted in a toilet tank and consisting of an exhaust assembly, a water seal backflow assembly and an electronic control assembly; the exhaust assembly consisting of an n-shaped exhaust hood, an exhaust electric motor, an exhaust tube and a telescopic tube; the exhaust assembly being fastened on the exhaust electric motor and the water seal backflow assembly through the n-shaped exhaust hood, the exhaust electric motor being located inside a top portion of the n-shaped exhaust hood above the water seal backflow assembly; the water seal backflow assembly consisting of a U-shaped water storage cup, an n-shaped water seal hood and the exhaust tube; the water seal backflow assembly having the exhaust tube as a main body, the exhaust tube being inserted through the U-shaped water storage cup to become an integrated one, an exhaust tube mouth being higher than a water level line, the n-shaped water seal hood being fastened in a chamber defined between the exhaust tube and the U-shaped water storage cup to form a first water seal chamber and a second water seal chamber; the electronic control assembly using a wire to connect a power supply, a power switch, an electronic program controller and a water level switch in series in an electronic circuit.

2. The water seal device as claimed in claim 1, wherein a chamfer formed between the exhaust electric motor and the n-shaped exhaust hood of the exhaust assembly is defined as a gas guide chamfer, the top portion of the n-shaped exhaust hood is formed with an air inlet, the n-shaped exhaust hood covers the entire water seal backflow assembly and extends downwardly beyond a bottom of the U-shaped water storage cup of the water seal backflow assembly, an upper part of the n-shaped exhaust hood is marked with the water level line, the water level line is disposed at a position higher than a mouth of the U-shaped water storage cup and lower than the exhaust tube mouth, the water level switch is disposed at the water level line; when a water surface reaches the water level line, the water level switch turns on the exhaust electric motor; when the water surface is lower than the water level line, the water level switch turns off the power supply of the exhaust electric motor.

3. The water seal device as claimed in claim 1, wherein a bottom of the first water seal chamber communicates with a bottom of the second water seal chamber of the water seal backflow assembly to form a U-shaped strap water seal; a water inlet chamber is formed between the n-shaped exhaust hood and the U-shaped water storage cup; the first water seal chamber, the second water seal chamber, the water inlet chamber and the exhaust tube substantially have equal cross-sectional areas; the exhaust tube, the first water seal chamber, the second water seal chamber and the water inlet chamber communicate with each other to form a ∩ -shaped chamber; the n-shaped exhaust hood, the exhaust tube, the U-shaped water storage cup and the n-shaped water seal hood are supported by a support that does not affect the flow of gas and water.

4. The water seal device as claimed in claim 1, wherein a gas pressure generated by the exhaust electric motor is greater than a water pressure of a water seal height of an S-bend of the toilet; and a water seal height of the U-shaped water storage cup is greater than the water seal height of the S-bend of the toilet.

* * * * *